US006639488B2

(12) United States Patent
Deligianni et al.

(10) Patent No.: US 6,639,488 B2
(45) Date of Patent: Oct. 28, 2003

(54) MEMS RF SWITCH WITH LOW ACTUATION VOLTAGE

(75) Inventors: Hariklia Deligianni, Tenafly, NJ (US); Robert Groves, Highland, NY (US); Christopher Jahnes, Upper Saddle River, NJ (US); Jennifer L. Lund, Amawak, NY (US); Panayotis Andricacos, Croton-on-Hudson, NY (US); John Cotte, New Fairfield, CT (US); L. Paivikki Buchwalter, Hopewell Junction, NY (US); David Seeger, Palisades, NY (US); Raul E. Acosta, White Plains, NY (US)

(73) Assignee: IBM Corporation, Armonk, NY (US)

( * ) Notice: Subject to any disclaimer, the term of this patent is extended or adjusted under 35 U.S.C. 154(b) by 0 days.

(21) Appl. No.: 09/948,478

(22) Filed: Sep. 7, 2001

(65) Prior Publication Data

US 2003/0048149 A1 Mar. 13, 2003

(51) Int. Cl.[7] ..... H01P 1/10
(52) U.S. Cl. ..... 333/101; 333/262
(58) Field of Search ..... 333/262, 105, 333/101; 200/181; 342/372; 257/528

(56) References Cited

U.S. PATENT DOCUMENTS 5,268,696 A * 12/1993 Buck et al. ..... 342/372
5,619,061 A * 4/1997 Goldsmith et al. ..... 257/528
6,160,230 A * 12/2000 McMillan et al. ..... 200/181
6,426,687 B1 * 7/2002 Osborn ..... 333/262

* cited by examiner

*Primary Examiner*—Robert Pascal
*Assistant Examiner*—Dean Takaoka
(74) *Attorney, Agent, or Firm*—Dilworth & Barrese, LLP

(57) ABSTRACT

Disclosed is a capacitive electrostatic MEMS RF switch comprised of a lower electrode that acts as both a transmission line and as an actuation electrode. Also, there is an array of one or more fixed beams above the lower electrode that is connected to ground. The lower electrode transmits the RF signal when the top beam or beams are up and when the upper beams are actuated and bent down, the transmission line is shunted to ground ending the RF transmission. A high dielectric constant material is used in the capacitive portion of the switch to achieve a high capacitance per unit area thus reducing the required chip area and enhancing the insertion loss characteristics in the non-actuated state. A gap between beam and lower electrode of less than 1 $\mu$m is incorporated in order to minimize the electrostatic potential (pull-in voltage) required to actuate the switch.

24 Claims, 13 Drawing Sheets

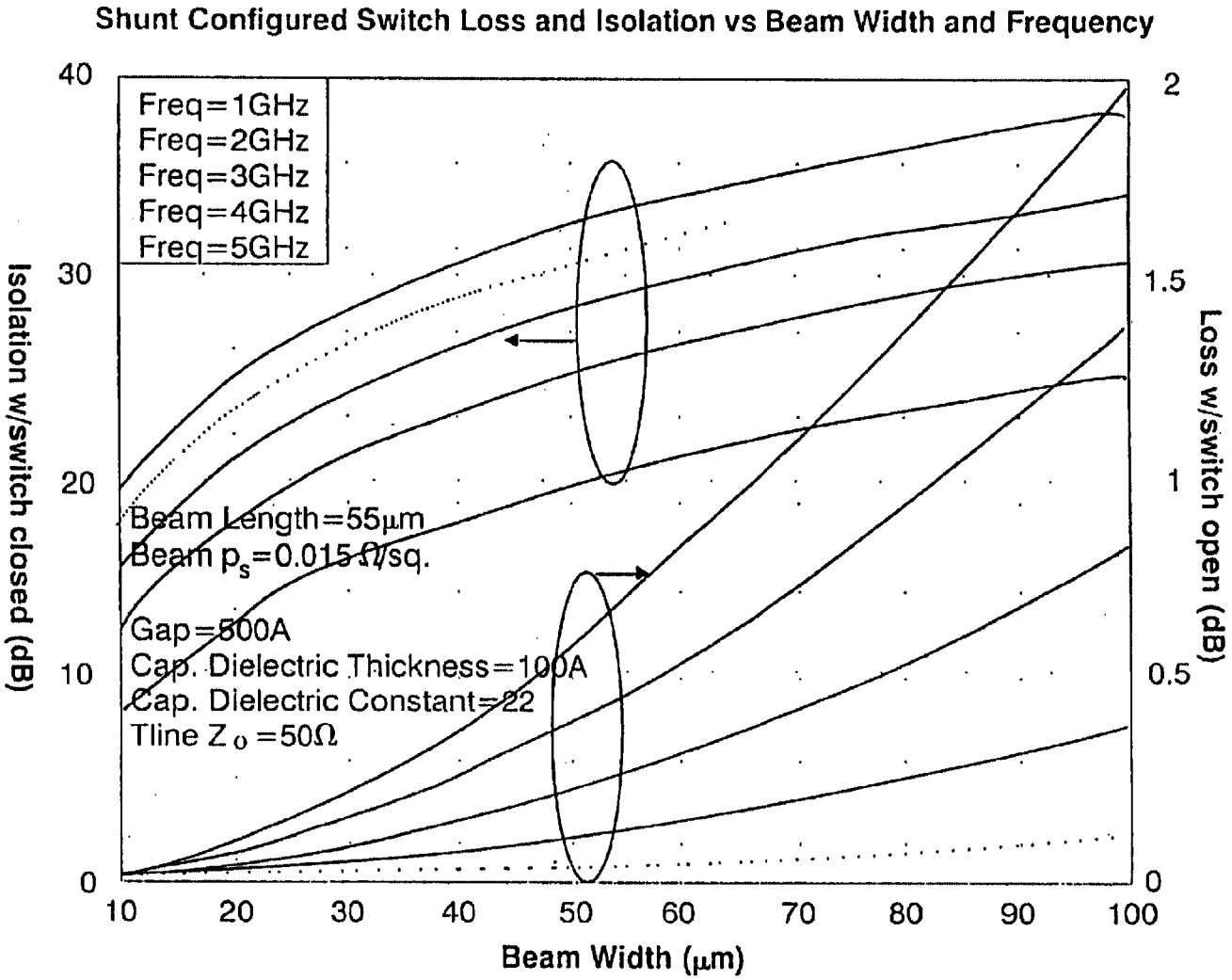
Figure 9
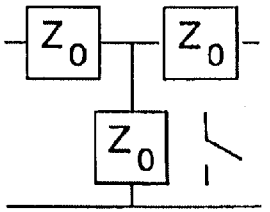
$Z_s$ includes switch cap. and series resistance in both open and closed state.

$Z_s$ includes switch cap. and series resistance in both open and closed state.

$Z_s$ includes switch cap. and series resistance in both open and closed state.

MEMS RF SWITCH WITH LOW ACTUATION VOLTAGE

FIELD OF THE INVENTION

The present invention relates generally to a micro-electromechanical (MEMS) radio frequency (RF) switch, and more specifically, to a MEMS switch that operates with a low actuation voltage, has a very low insertion loss, and good isolation.

BACKGROUND OF THE INVENTION

A radio-frequency (RF) switch is a device that controls the flow of an RF signal, or it may be a device that controls a component or device in an RF circuit or system in which an RF signal is conveyed. As is contemplated herein, an RF signal is one which encompasses low and high RF frequencies over the entire spectrum of the electromagnetic waves, from a few Hertz to microwave and millimeter-wave frequencies. A micro-electromechanical system (MEMS) is a device or system fabricated using semiconductor integrated circuit (IC) fabrication technology. A MEMS switch is such a device that controls the flow of an RF signal. MEMS devices are small in size, and feature significant advantages in that their small size translates into a high electrical performance, since stray capacitance and inductance are virtually eliminated in such an electrically small structure as measured in wavelengths. In addition, a MEMS switch may be produced at a low-cost due to the IC manufacturing process employed in its fabrication. MEMS switches are termed electrostatic MEMS switches if they are actuated or controlled using electrostatic force which turns such switches on and off. Electrostatic MEMS switches are advantageous due to low power-consumption because they can be actuated using electrostatic force induced by the application of a voltage with virtually no current. This advantage is of paramount importance for portable systems, which are operated by small batteries with very limited stored energy. Such portable systems might include hand-held cellular phones and laptop personal computers, for which power-consumption is recognized as a significant operating limitation. Even for systems that have a sufficient AC or DC power supply such as those operating in a building with AC power outlets or in a car with a large DC battery and a generator, low power-consumption is still a desirable feature because power dissipation creates heat which can be a problem in a circuit loaded with many IC's. However, a major disadvantage exists in prior art MEMS switches, which require a large voltage to actuate the MEMS switch. Such a voltage is typically termed a "pull-down" voltage, and, in the prior art may be anywhere from 20 to 40 volts or more in magnitude and therefore not compatible with modem portable communications systems, which typically operate at 3 volts or less. To explain further, a typical MEMS switch uses electrostatic force to cause mechanical movement that results in electrically bridging a gap between two contacts such as in the bending of a cantilever. In general this gap is relatively large in order to achieve a large impedance during the "off" state of the MEMS switch. Consequently, the aforementioned large pull-down voltage of anywhere from 20 to 40 volts or more is usually required in these designs to electrically bridge the large gap. Also, a typical MEMS switch has a useful life of approximately $10^8$ to $10^9$ cycles. Thus, in addition to the above concerns, there is an interest in increasing the lifetime of such MEMS switches. Thus there is a need for an electrostatic MEMS switch that is actuated by a low pull-down or actuating voltage and has low power consumption with increased cycle life.

SUMMARY

It is, therefore, an object of the present invention to provide a micro-electromechanical (MEMS) switch that operates with a low actuation voltage, and has a very low insertion loss and good isolation.

It is another object of the present invention to provide a fabrication process that is fully compatible with CMOS, BiCMOS, and SiGe processing, and can be monolithically integrated at the upper levels of chip wiring.

To achieve the above objects, there is provided a capacitive electrostatic MEMS RF switch comprised of a lower electrode that acts as both a transmission line and as an actuation electrode. Also, there is an array of fixed beams that is connected to ground above the lower electrode. The lower electrode transmits the RF signal when the upper beams are up, and when the upper beams are actuated and bent down, the transmission line is shunted to ground.

BRIEF DESCRIPTION OF THE FIGURES

The above and other aspects, features and advantages of the present invention will become more apparent from the following detailed description when taken in conjunction with the accompanying figures, in which:

FIGS. 9–11 are charts illustrating performance characteristics of switches according to the present invention.

DETAILED DESCRIPTION OF THE INVENTION

Preferred embodiments of the present invention will be described herein below with reference to the accompanying drawings. In the following description, well-known functions or constructions are not described in detail since they would obscure the invention in unnecessary detail.

Figure 1:
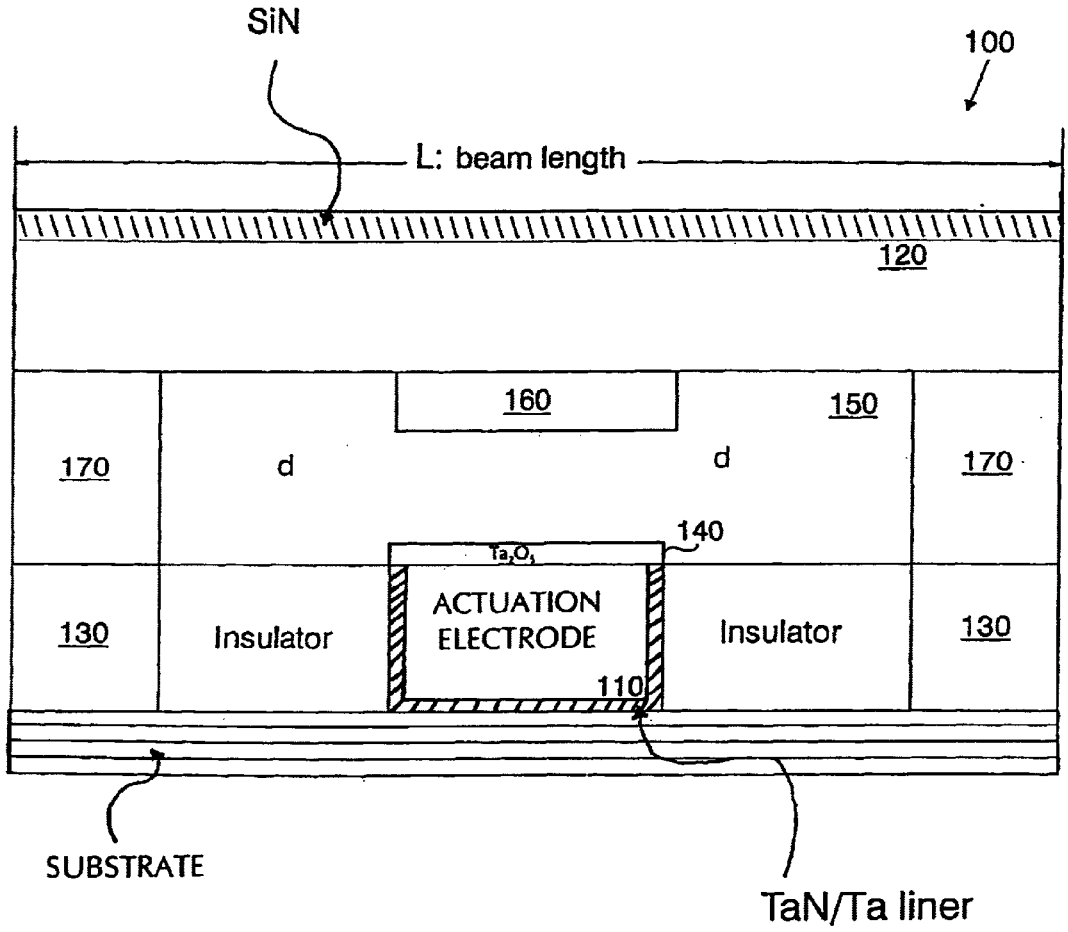
FIG. 1 is a diagram illustrating a cross-section of a metal-dielectric-metal MEMS switch using CMOS metal levels and $Ta_2O_5$ (Tantalum Pentoxide) as dielectric material.

A diagram illustrating a cross-section of a metal-dielectric-metal MEMS switch 100 using CMOS metal levels and $Ta_2O_5$ (Tantalum Pentoxide) as dielectric material is shown in FIG. 1. The switch comprises a single lower electrode 110 (or first electrode), attached to a substrate, that acts both as a transmission line and as an actuation electrode. Also, there is an array of fixed upper beams 120 acting as support elements that are connected to ground 130 above the lower electrode 110. Beams 120 are attached to supports 170 fixed to the substrate, creating a space 150. Attached to the upper beams 120 is an upper electrode 160 (or second electrode). This upper electrode 160 can be comprised of, for example, copper (Cu), tungsten (W), Aluminum (Al), gold (Au), nickel (Ni) and alloys thereof. The lower electrode 110 transmits an RF signal when the upper beams 120 are up and the switch is in the open position. The lower electrode 110 consists of copper back-end layers encapsulated on three sides by TaN/Ta (Tantalum Nitride/Tantalum) barrier material. The top copper surface of the lower electrode is protected by Ta (Tantalum), TaN (Tantalum Nitride), Ta/TaN (Tantalum/Tantalum Nitride), or TaN/Ta (Tantalum Nitride/Tantalum). This protective layer is either fully or partially anodized to yield a thin $Ta_2O_5$ (Tantalum Pentoxide) (100–2000 Angstroms) layer 140, a dielectric material with a dielectric constant of 22. It is possible to use another dielectric material but it is preferred that the dielectric constant be above 10. Some available alternatives are barium strontium titanate, hafnium oxide, hafnium silicate, zirconium oxide, zirconium silicate, lead zirconium titanate, lead silicate, and titanium oxide. It is possible to use methods other than anodization to deposit the high dielectric constant material, such as sputtering or CVD (chemical vapor deposition). When a voltage is applied to the lower electrode 110, the upper beams 120 are bent down and the upper electrode 160 comes in contact with the lower electrode 110. At this point, a conducting path is created though the lower electrode 110 and the upper beams 120 shunting the RF signal to ground.

When the upper beams 120, fabricated using a copper Damascene approach are actuated and bent down (placing the switch in the closed position), the upper electrode 160 touches the anodized $Ta_2O_5$ (Tantalum Pentoxide) layer 140 on the lower electrode 110, and the transmission line is shunted to ground 130 through the resulting capacitance. The release of the upper beams 120 (creating the space 150 between the electrode 110 and the beams 120) is performed by etching, with an oxygen containing plasma, leaving the space 150 between the lower electrode 110 and the beams 120. The material removed during the etch can be selected from a group consisting of: SiLK (an example of a class of highly aromatic arylene ethers), BCB (benzocyclobutane), polyimides, unzipping polymers such as PMMA (polymethyhnethacrylate), suitable organic polymers, a-C:H (e.g. Diamond Like Carbon) or a-C:HF (e.g. Fluorinated Diamond Like Carbon. Typical dimensions for the space 150 between the lower electrodes 110 and the beams 120 are 500–1000 Angstroms requiring actuation voltages of less than 3 Volts. Length of the beams 120 vary from 35–100 $\mu$m and the lower actuation electrode area is on the order of 2000–3000 $\mu m^2$ (i.e. 50×50, 60×40, 70×40 etc.). The thickness of the beams 120 is 1–5 $\mu$m and the individual beam width varies from 5–20 $\mu$m.

Figure 2A:
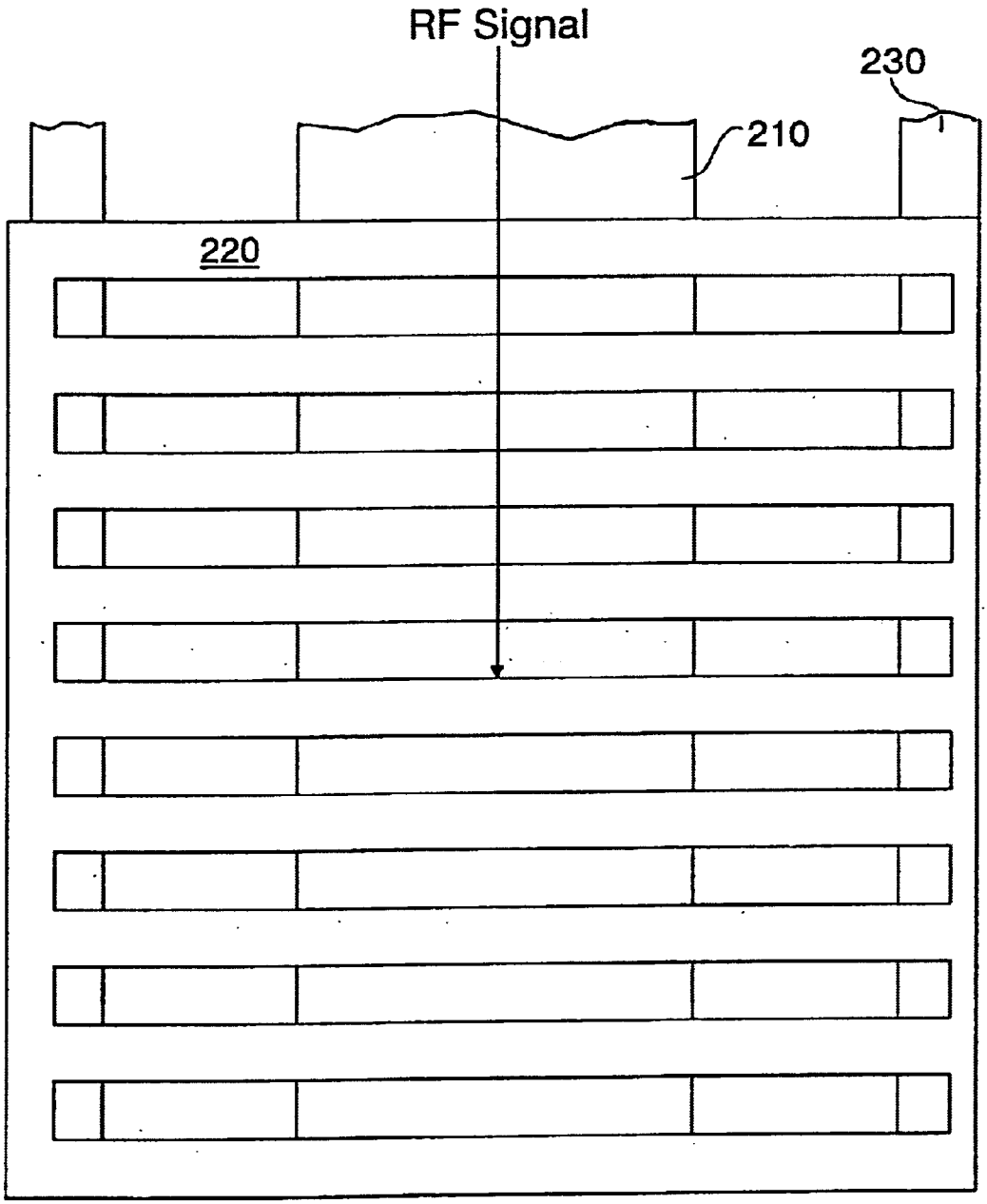
FIG. 2*a* is a diagram illustrating a top view of a metal-dielectric-metal MEMS switch with fixed beams connected at both ends to ground.

FIG. 2*a* is a diagram illustrating a top view of a metal-dielectric-metal MEMS switch showing fixed beams connected at both ends to ground. The top electrode consists of a set of beams 220 either connected together at both ends or individually connected to the lower ground electrodes 230. An advantage of this configuration is that by having multiple beams, a large overlap area is created with the lower electrode 210 that results in effective grounding of the RF signal when the top beams 220 are pulled down, contacting the upper electrode to the high dielectric constant material of the lower electrode 210. Another advantage of this multiple beam configuration is the ability of single beams to achieve higher switching frequencies than a flat rectangular plate. Also, single beams are less likely to deform with multiple actuation, a common problem encountered when using a flat rectangular plate. The beam width can also be variable along its length. In a preferred embodiment, the set of beams are covered by a layer selected from a group consisting of silicon nitride and silicone dioxide.

Figure 2B:
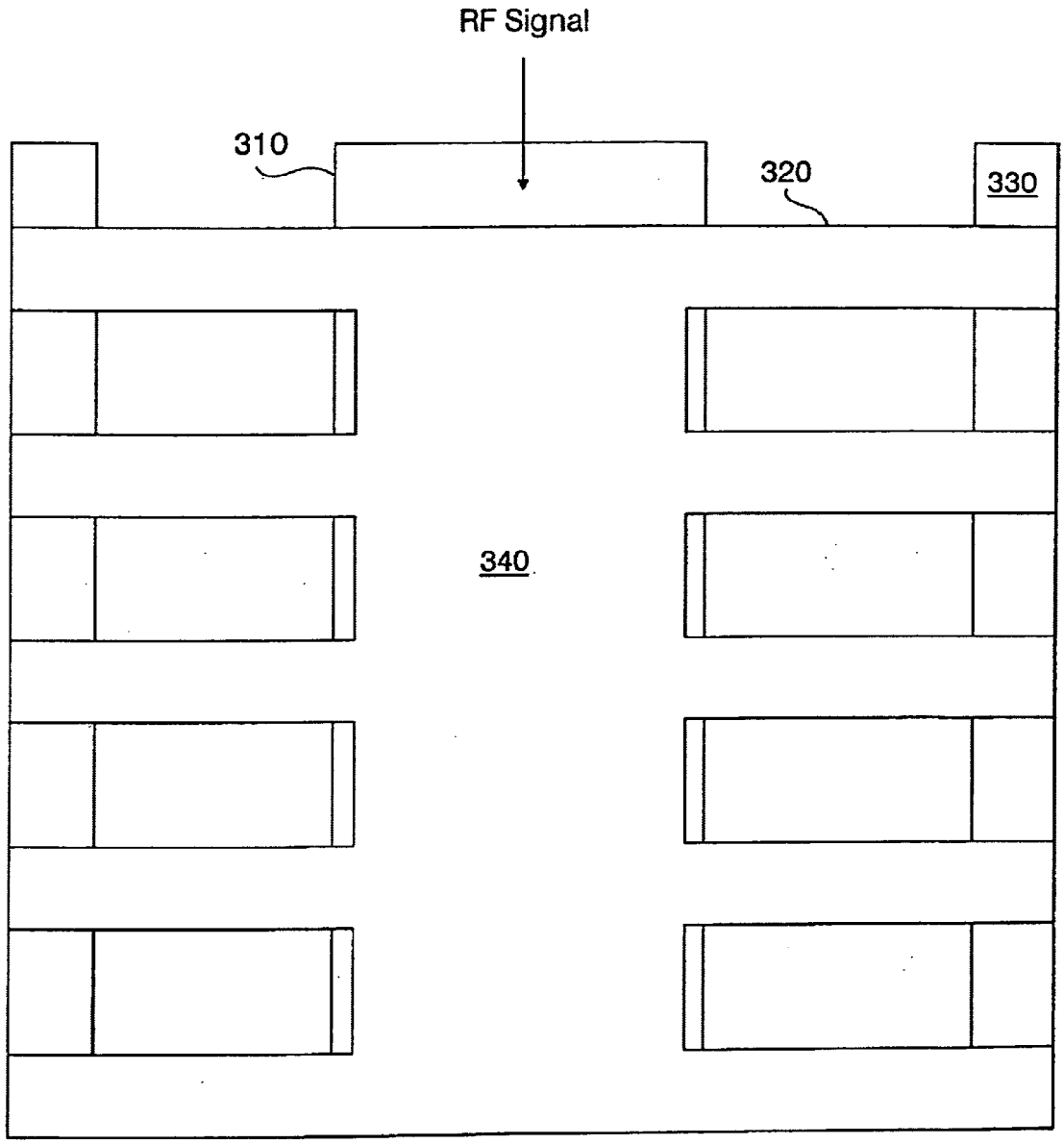
FIG. 2*b* is a diagram illustrating a top view of a metal-dielectric-metal MEMS switch showing yet another embodiment of the present invention.

FIG. 2*b* is a diagram illustrating a top view of a metal-dielectric-metal MEMS switch showing another embodiment of the present invention. The top electrode beams 320 are connected together at the center where they form an overlap area 340 on top of the RF signal electrode (or lower actuation electrode) 310. The top beams 320 are all connected to ground 330 at both ends but they could also be connected with each other at their fixed ends or in different locations along their length.

Figure 2C:
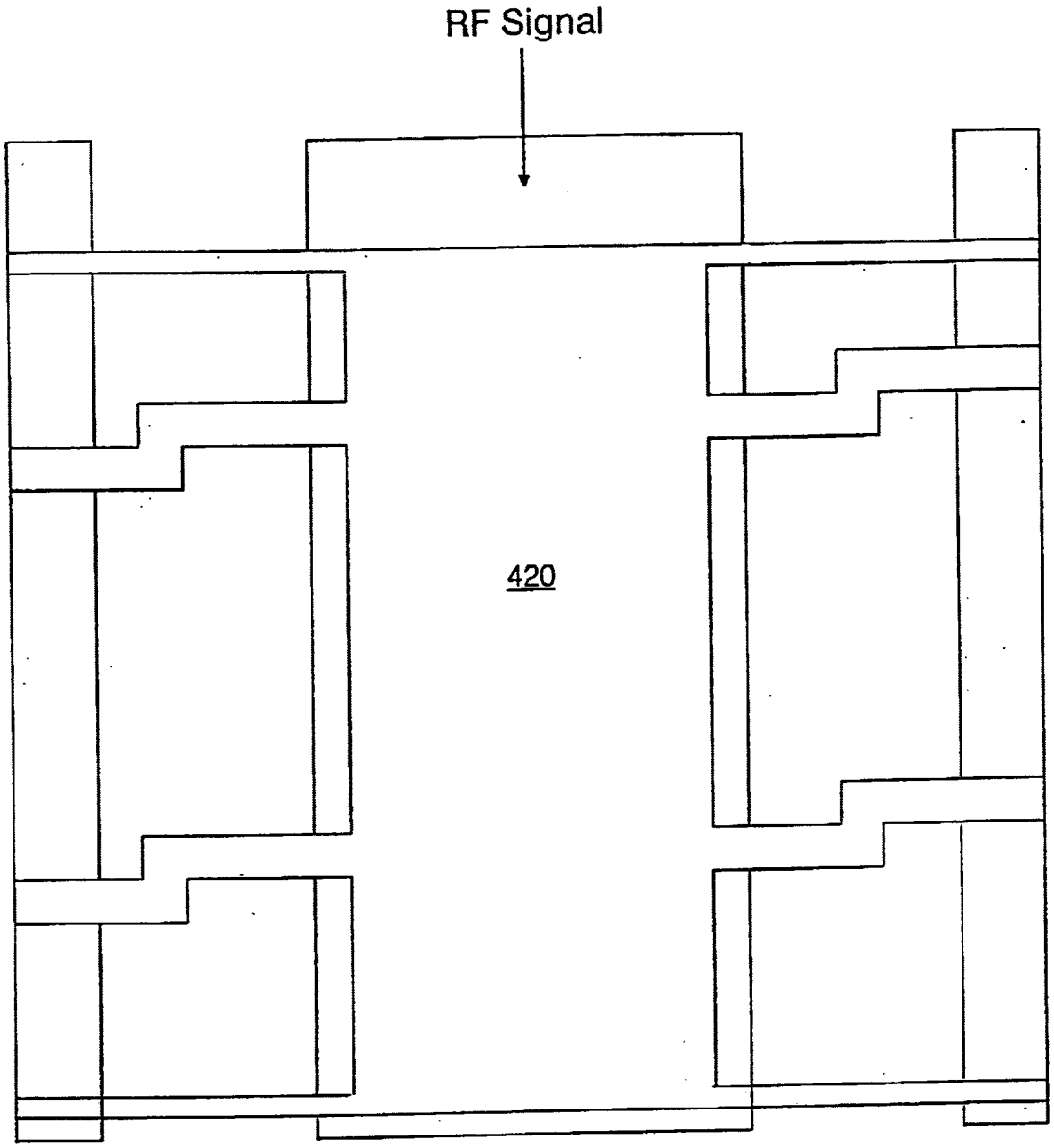
FIG. 2*c* is a diagram illustrating a top view of a metal-dielectric-metal MEMS switch showing another embodiment of the present invention.

FIG. 2*c* is a diagram illustrating a top view of a metal-dielectric-metal MEMS switch showing yet another embodiment of the present invention. The shape of the middle upper beams 420 is modified to yield a lower actuation voltage.

Figure 3:
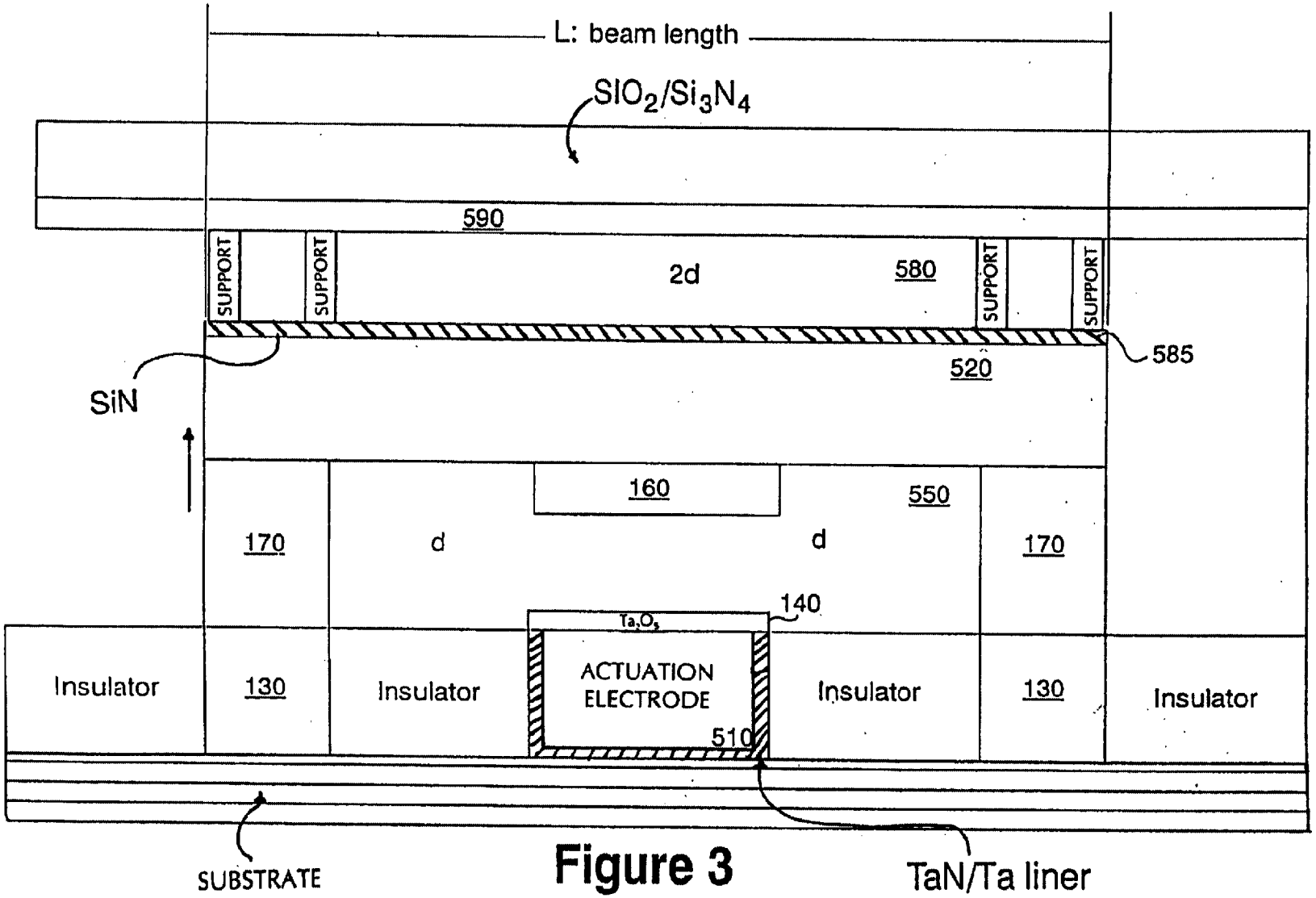
FIG. 3 is a diagram illustrating a cross-section of a metal-dielectric-metal MEMS switch using CMOS metal levels and $Ta_2O_5$ (Tantalum Pentoxide) as dielectric material, and a top actuation (or pull-up) electrode in a cavity.

FIG. 3 is a diagram illustrating a cross-sectional view of a metal-dielectric-metal MEMS switch using CMOS metal levels and $Ta_2O_5$ (Tantalum Pentoxide) as dielectric material, and a top actuation (or pull-up) electrode in a cavity. In this embodiment, lower space 550 preferably defines a distance (d) from the beams 520 to bottom electrode 510. Upper space 580, from surface 585 to the top electrode 590, preferably defines a distance (2*d*), although it is contemplated that the distance between surface 585 and top electrode 590 may be equal to distance (d), so that the distance is in the range of d to 2*d*. When actuated, this electrode 590 assists in releasing the beams 520 from the bottom electrode 510 by pulling up on the beams 520. The top surface of the upper space 580 may have small access holes through which release of the structure can be achieved. As a result, the top actuation electrode 590 may be perforated. Materials that can be used for this electrode are Titanium Nitride (TiN), Tungsten (W), Tantalum (Ta), Tantalum Nitride (TaN), or copper (Cu) cladded by Tantalum Nitride/Tantalum (TaN/Ta).

Figure 4:
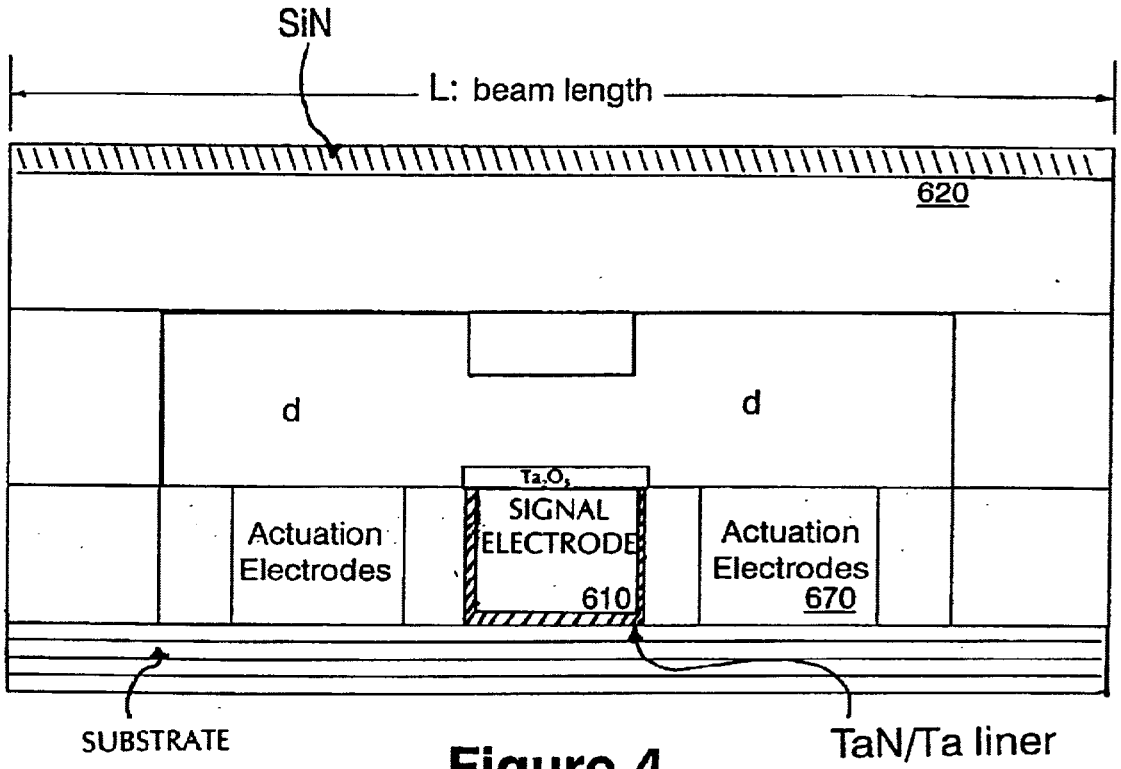
FIG. 4 is a diagram illustrating a cross-section of a metal-dielectric-metal MEMS switch with two separate actuation electrodes, using CMOS metal levels and $Ta_2O_5$ (Tantalum Pentoxide) as dielectric material.
Figure 5:
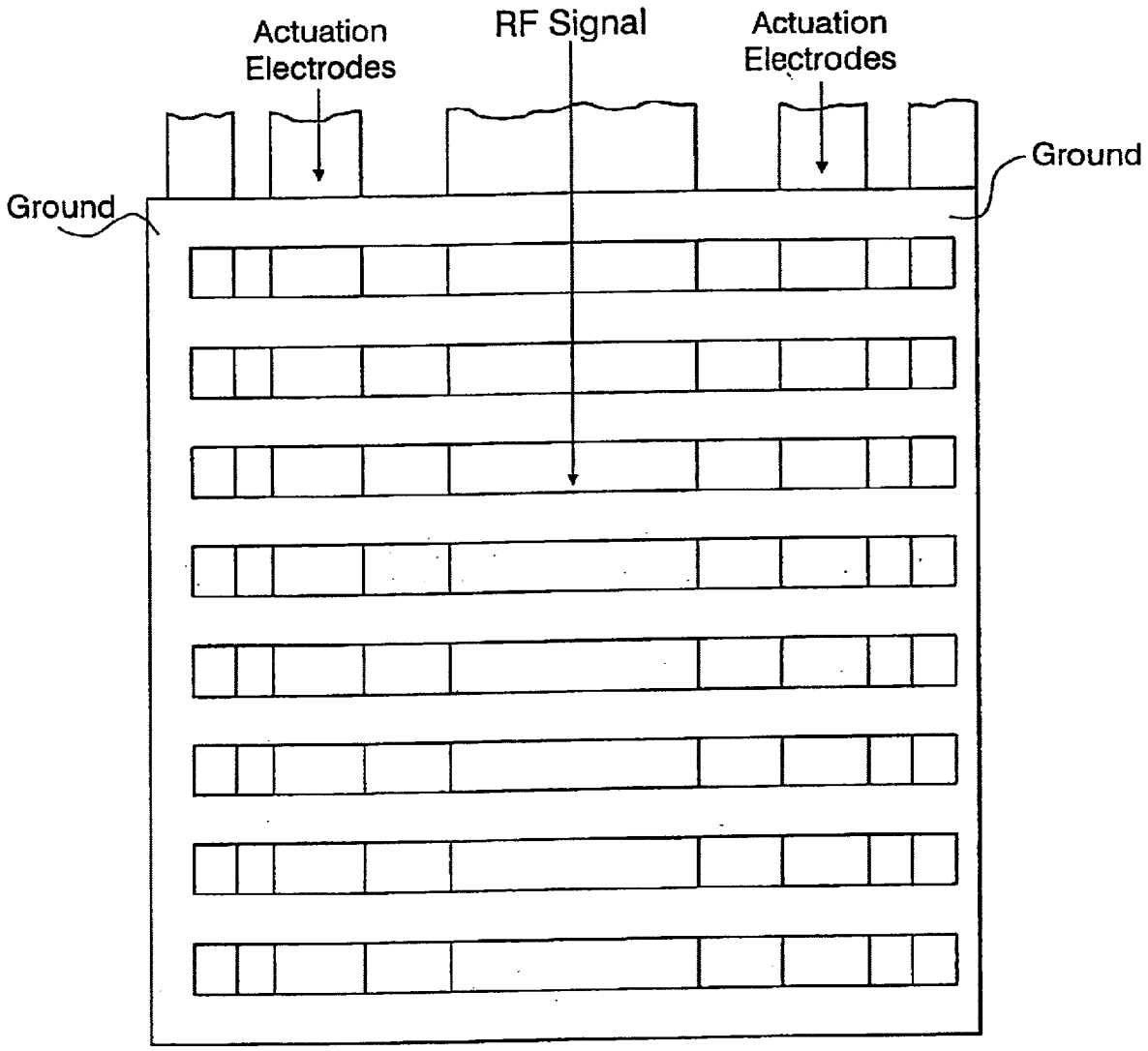
FIG. 5 is a diagram illustrating a top view of the metal-dielectric-metal MEMS switch of FIG. 4.

FIG. 4 is a diagram illustrating a cross-section of a metal-dielectric-metal MEMS switch using CMOS metal levels and $Ta_2O_5$ (Tantalum Pentoxide) as dielectric material, but with two separate actuation electrodes 670. By utilizing two separate actuation electrodes 670, it is possible to separate the DC voltage in the actuation electrodes 670 from the RF potential of the RF signal electrode, creating circuit design advantages to those skilled in the art. In the case of multiple lower electrodes 670 and 610, a beam 620 length of 100 mm can be used with two lower actuation electrodes 670 that are 25 $\mu$m long and an RF signal electrode 610 that is 50 μm long. A top view of this embodiment of the switch is illustrated in FIG. 5.

Figure 6A:
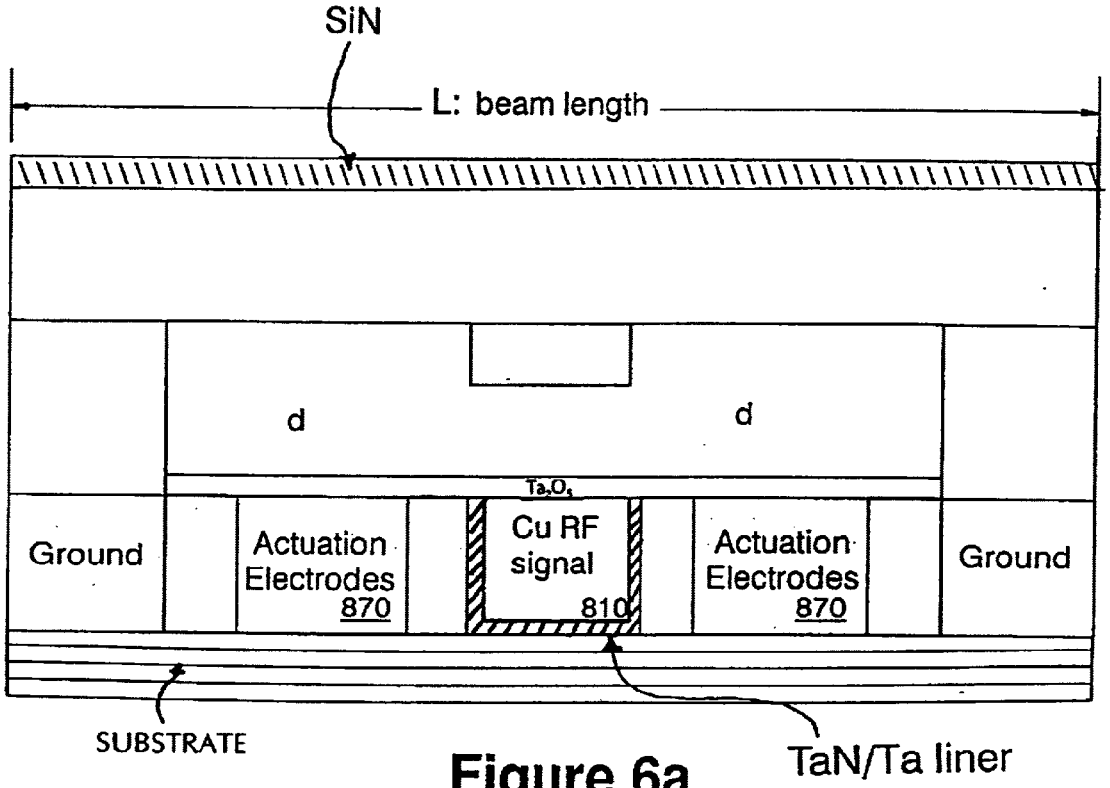
FIG. 6*a* is a diagram illustrating a cross-section of another embodiment of a metal-dielectric-metal MEMS switch with two separate actuation electrodes using CMOS metal levels and a $Ta_2O_5$ (Tantalum Pentoxide) dielectric material.

FIG. 6*a* is a diagram illustrating a cross-section of another embodiment of a metal-dielectric-metal MEMS switch with two separate actuation electrodes using CMOS metal levels and a $Ta_2O_5$ (Tantalum Pentoxide) dielectric material. FIG. 6*a* shows a continuous $Ta_2O_5$ (Tantalum Pentoxide) layer 840 across all three lower electrodes 870 and the transmission line 810. This increases the effective dielectric constant of the coplanar wave (CPW) guide structure consisting of the center transmission line 810 and the actuation electrodes 870 on either side. The increased dielectric constant will yield a transmission line 810 with a lower characteristic impedance, making it useful for impedance matching to low impedance active elements. Additionally, the wavelength will be reduced due to the increased dielectric constant allowing distributed elements (i.e. quarter wavelength transmission lines) to be shorter, taking up less space. Finally, the increased dielectric constant will tend to guide the fringing fields of the CPW structure away from the substrate cutting down on power loss in the substrate. A key advantage to using a CPW transmission line lies in the wide range of characteristic impedance values achievable by varying the signal to ground spacing (here, signal to actuation electrode 870 spacing). This design freedom is not as easily achievable with a standard microstrip line configuration, especially in a standard silicon back end, where the signal to ground plane spacing is quite small (on the order of a few microns).

To construct the structure illustrated in FIG. 6*a*, a Ta (Tantalum), TaN (Tantalum Nitride), Ta/TaN (Tantalum/Tantalum Nitride), or TaN/Ta (Tantalum Nitride/Tantalum) layer is deposited on top of the copper electrodes. The copper lower electrodes 810 and 870 are typically recessed after chemical mechanical polishing (CMP). The TaN (Tantalum Nitride) layer at the top surface is continuous on top of the insulator in-between electrodes. Anodization of this layer will convert it to $Ta_2O_5$ (Tantalum Pentoxide) so that the oxide is in contact with the insulator material between electrodes.

Figure 6B:
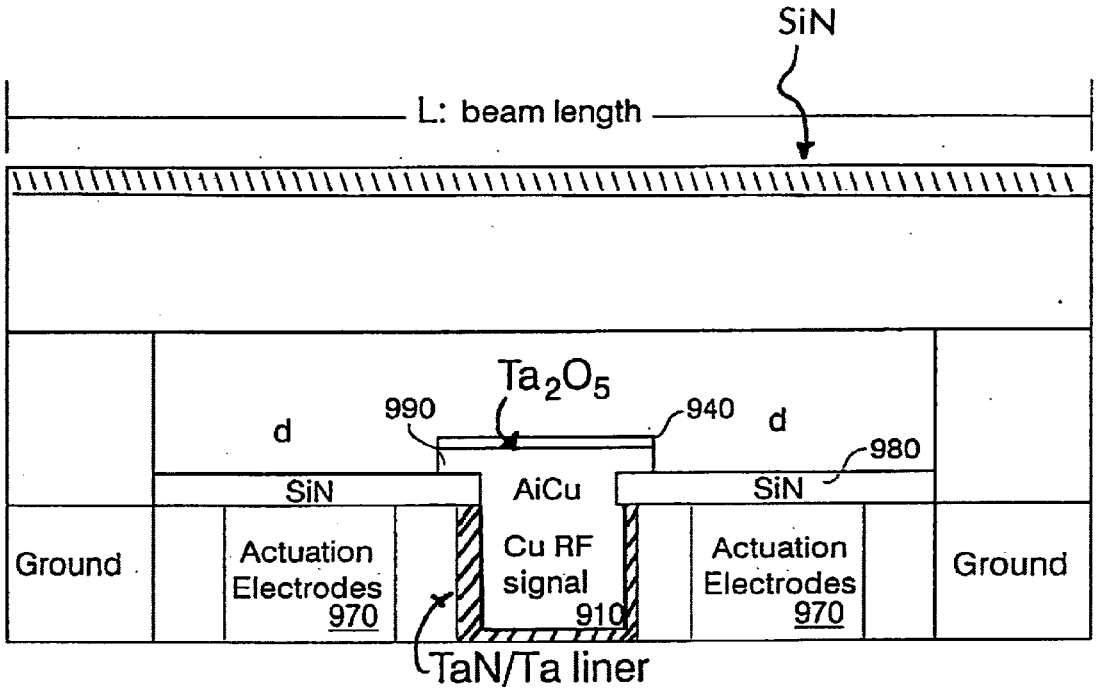
FIG. 6*b* is a diagram illustrating a cross-section of yet another metal-dielectric-metal MEMS switch with two separate actuation electrodes using CMOS metal levels and $Ta_2O_5$ (Tantalum Pentoxide) as dielectric material.

FIG. 6*b* is a diagram illustrating a cross-section of yet another metal-dielectric-metal MEMS switch with two separate actuation electrodes using CMOS metal levels and $Ta_2O_5$ (Tantalum Pentoxide) as dielectric material. The lower copper electrodes 910 and 970 are capped by a thin Ta (Tantalum) layer. The Ta (Tantalum) is removed from the top surface by CMP. A $Si_3N_4$ (Silicon Nitride) layer 980 is deposited as a blanket film covering the three lower electrodes 910 and 970 to prevent chemical interaction between the lower electrodes 910 and 970, and the first layer of dielectric material. On top of the center electrode 910 area, the nitride is etched down to the liner which is subsequently patterned in the center electrode 910 and an AlCu layer 990 is deposited to allow for electrical contact of the TaN (Tantalum Nitride) anodization. Finally, a TaN (Tantalum Nitride) layer 940 is deposited and converted to $Ta_2O_5$ (Tantalum Pentoxide) by anodization and subsequently patterned along with the AlCu (Aluminum Copper) layer 990 to result in a protruding center electrode 910 capped by the high dielectric constant material.

Figure 7:
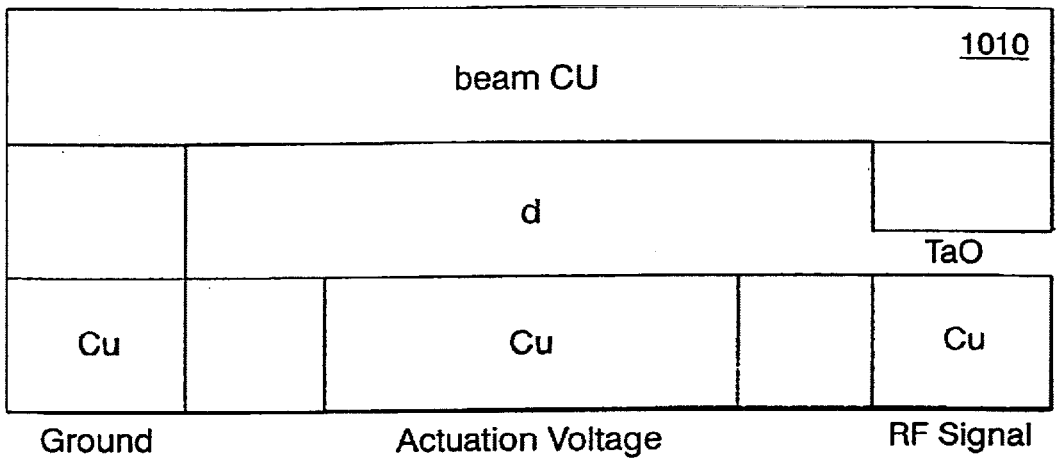
FIG. 7 is a diagram illustrating a cantilever metal-dielectric-metal switch.
Figure 8:
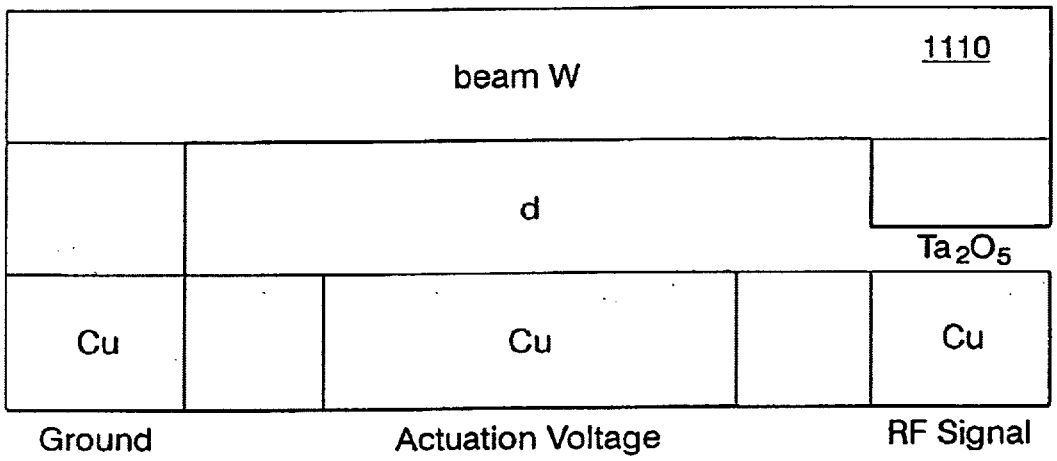
FIG. 8 is a diagram illustrating another embodiment of a cantilever metal-dielectric-metal switch.

FIGS. 7 and 8 are variations of the switch top electrodes using cantilever beams 1010 and 1110, and copper (FIG. 7) or tungsten (FIG. 8) as beam materials. The end of the cantilever that does the shorting to ground extends beyond the beam thickness. This is because cantilevers have shown to have instabilities when actuated. The "tip" approach can also be used with fixed beams or plates, but extra fabrication mask levels will be needed.

Figure 10:
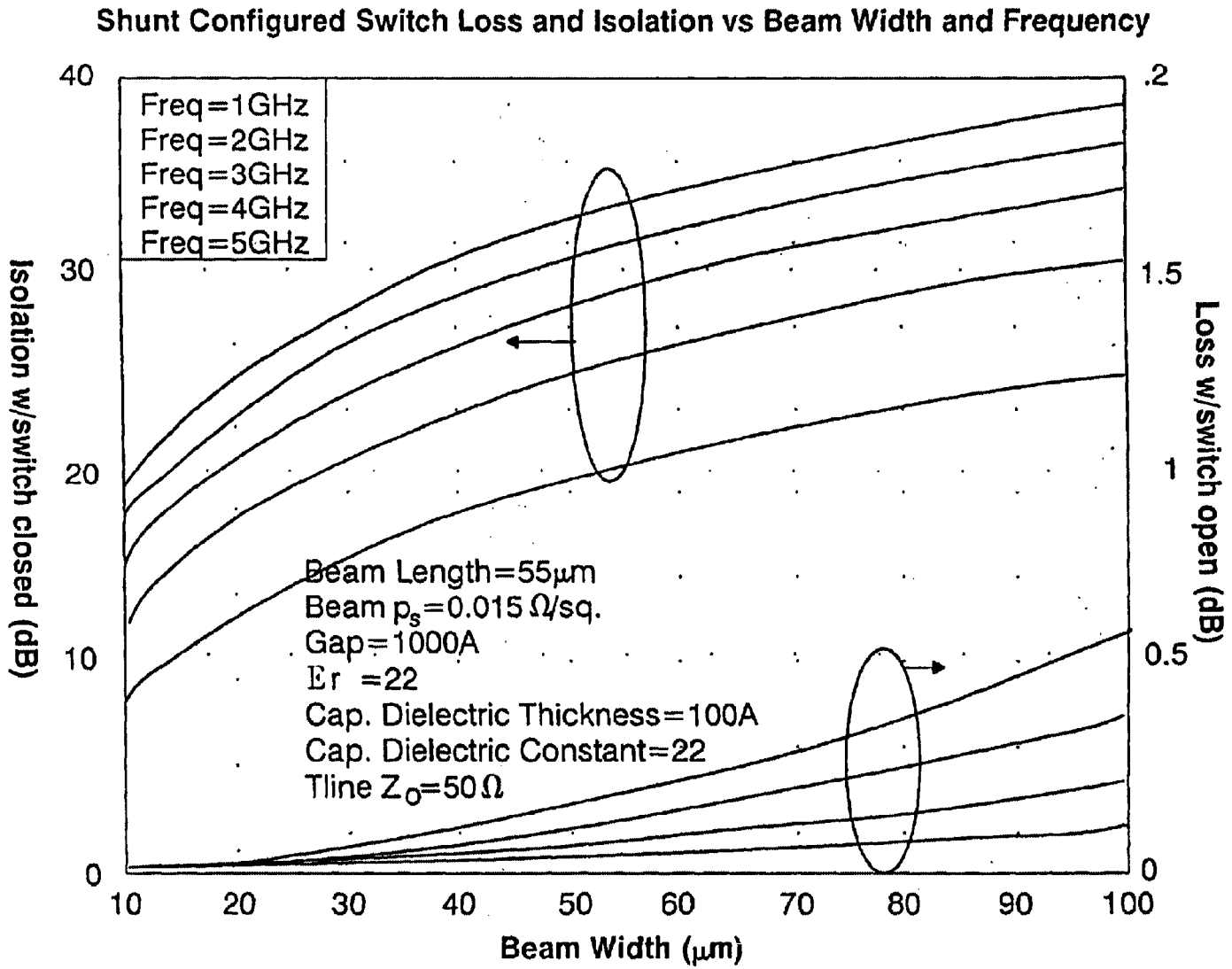
Figure 10:
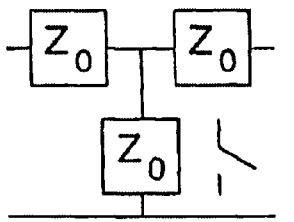
Figure 11:
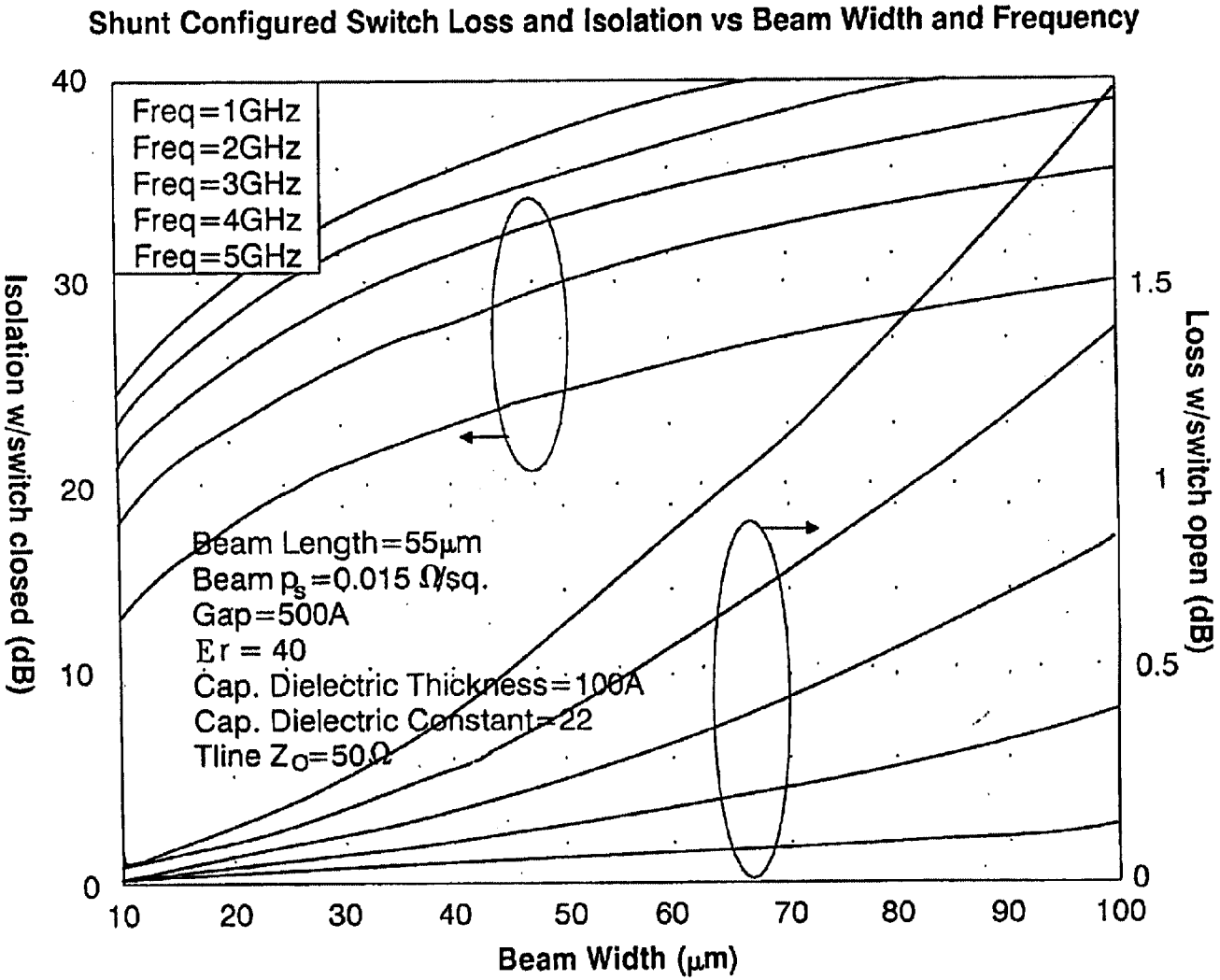
Figure 11:
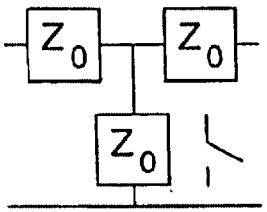

FIGS. 9–11 are charts illustrating performance characteristics of switches according to the present invention. FIG. 10 illustrates that excellent isolation (more than 30 dB) and insertion loss (less than 0.2 dB) can be obtained using beams 55 μm long and with a total width of 80 μm (individual beams are 5–20 μm wide). A set of 4–8 beams can be used to realize this switch.

FIG. 11 illustrates the benefits of introducing a dielectric material with higher dielectric constant such as $HfO_2$ (Hafnium Oxide) (dielectric constant of 40) or sputtered BSTO (Barium Strontium Titanate) (dielectric constant of 30). By implementing dielectric material with a high dielectric constant, improved switch characteristics, especially in terms of isolation, are achieved.

While the invention has been shown and described with reference to certain preferred embodiments thereof, it will be understood by those skilled in the art that various changes in form and details may be made therein without departing from the spirit and scope of the invention as defined by the appended claims.

We claim:

1. A MEMS (micro-electromechanical) RF switch apparatus operable under low actuation voltage, the apparatus comprising:

a substrate;

a first electrode attached to the substrate;

a first layer of dielectric material having a dielectric constant above 10 on the first electrode;

a second electrode positioned above the first electrode creating a first space having a height less than 5000 Angstroms between the first layer of dielectric and the second electrode; and a support element for suspending the second electrode when the switch is in an open position and for moving the second electrode when the second electrode is pulled to the layer of dielectric material when the switch is in a closed position in response to a voltage between the first and second electrodes.

2. The MEMS RF switch apparatus of claim 1 wherein the first electrode forms a transmission line.

3. The capacitive MEMS RF switch apparatus of claim 1 wherein the first electrode is an actuation electrode.

4. The MEMS RF switch apparatus of claim 1 wherein a capacitance between the first and second electrodes when the switch is in the closed position creates an RF short between the first and second electrodes.

5. The MEMS RF switch apparatus of claim 1 wherein the second electrode forms a transmission line.

6. The MEMS RF switch apparatus of claim 1 wherein the support element comprises a plurality of beams, electrically coupled together, between the second electrode and a fixed support attached to the substrate to provide mechanical isolation between the beams.

7. The MEMS RF switch apparatus of claim 6 wherein the plurality of beams are covered by a layer selected from a group consisting of silicon nitride and silicone dioxide.

8. The MEMS RF switch apparatus of claim 1 wherein the support element comprises a plurality of spaced beams, each beam having a first and second end attached to fixed supports attached to the substrate, and the second electrode is coupled to the beams between the first and second ends.

9. The MEMS RF switch apparatus of claim 1 wherein a voltage of three volts or less causes the switch to actuate to a closed position.

10. The MEMS RF switch apparatus of claim 1 wherein a top surface of the first electrode is covered with a liner to prevent chemical interaction between the first electrode and the first layer of dielectric material.

11. The MEMS RF switch apparatus of claim 1 further comprising actuation electrodes attached to the substrate on opposite sides of the first electrode.

12. The MEMS RF switch apparatus of claim 1 wherein the first layer of dielectric material is selected from a group consisting of tantalum oxide, barium strontium titanate, hafnium oxide, hafnium silicate, zirconium oxide, zirconium silicate, lead zirconium titanate, lead silicate, titanium oxide, and other dielectric materials with a dielectric constant greater than 10.

13. The MEMS RF switch apparatus of claim 1 wherein the second electrode is selected from a group consisting of copper (Cu), tungsten (W), aluminum (Al), gold (Au), nickel (Ni) and alloys thereof.

14. A method for fabricating a MEMS RF switch apparatus operable under a low actuation voltage, the method comprising:

selecting a substrate;

fixing a first electrode to the substrate;

fixing a first layer of dielectric material having a dielectric constant above 10 on the first electrode;

attaching a second electrode to a flexible support element positioned above the first electrode creating a first space having a height (d) between the first electrode and the second electrode; and attaching a third electrode to a non-flexible support element positioned above the second electrode creating a space having a height no greater than (2d) between the third electrode and the flexible support element;

the third electrode attached above the second electrode to create a second space having a height between 500 and 10000 Angstroms between the second and third electrodes;

wherein the flexible support element suspends the second electrode when the switch is in an open position and pulls the second electrode to the layer of dielectric material when the switch is in a closed position in response to a voltage between the first and second electrodes.

15. A MEMS (micro-electromechanical) RF switch apparatus operable under low actuation voltage, the apparatus comprising:

a substrate;

a first electrode attached to the substrate;

a first layer of dielectric material having a dielectric constant above 10 on the first electrode;

a second electrode positioned above the first electrode creating a first space having a height less than 5000 Angstroms between the first layer of dielectric and the second electrode;

a support element for suspending the second electrode when the switch is in an open position and for moving the second electrode when the second electrode is pulled to the layer of dielectric material when the switch is in a closed position in response to a voltage between the first and second electrodes; and a third electrode positioned above the second electrode creating a second space having a height between 500 and 10000 Angstroms between the second and third electrodes.

16. The MEMS RF switch apparatus of claim 15 wherein the third electrode forms a transmission line.

17. The MEMS RF switch apparatus of claim 15 wherein the third electrode is a pull-up electrode for pulling the second electrode up from the first electrode.

18. The MEMS RF switch apparatus of claim 15 further comprising a second layer of dielectric material covering the surface of the second electrode facing the second space.

19. The MEMS RF switch apparatus of claim 15 wherein the third electrode further comprises a layer of $Si_3N_4$ (Silicon Nitride) on a top surface of the third electrode.

20. A MEMS (micro-electromechanical) RF switch apparatus operable under low actuation voltage, the apparatus comprising:

a substrate;

a first electrode attached to the substrate;

a first layer of dielectric material having a dielectric constant above 10 on the first electrode;

a second electrode positioned above the first electrode creating a first space having a height less than 5000 Angstroms between the first layer of dielectric and the second electrode; and a support element for suspending the second electrode when the switch is in an open position and for moving the second electrode when the second electrode is pulled to the layer of dielectric material when the switch is in a closed position in response to a voltage between the first and second electrodes, wherein the support element comprises at least one beam having one end attached to the second electrode, and a second end attached to the substrate.

21. The MEMS RF switch apparatus of claim 20 wherein the first electrode forms a transmission line.

22. The MEMS RF switch apparatus of claim 20 wherein the first electrode is an actuation electrode.

23. The MEMS RF switch apparatus of claim 20 wherein a capacitance between the first and second electrodes when the switch is in the closed position creates an RF short between the first and second electrodes.

24. The MEMS RF switch apparatus of claim 20 wherein the second electrode forms a transmission line.

* * * * *